US010486223B2

(12) United States Patent
Li et al.

(10) Patent No.: US 10,486,223 B2
(45) Date of Patent: Nov. 26, 2019

(54) METHOD FOR MANUFACTURING A GOLF CLUB HEAD

(71) Applicant: FUSHENG PRECISION CO., LTD, Taipei (TW)

(72) Inventors: Bao-Bin Li, Zhongshan (CN); Zhi-Nan Lin, Foshan (CN)

(73) Assignee: Fusheng Precision Co., Ltd., Taipei (TW)

( * ) Notice: Subject to any disclaimer, the term of this patent is extended or adjusted under 35 U.S.C. 154(b) by 177 days.

(21) Appl. No.: 15/653,598

(22) Filed: Jul. 19, 2017

(65) Prior Publication Data

US 2018/0104738 A1 Apr. 19, 2018

(30) Foreign Application Priority Data

Oct. 19, 2016 (CN) ..... 2016 1 0910272

(51) Int. Cl.
*C21D 6/04* (2006.01)
*B21K 17/00* (2006.01)
(Continued)

(52) U.S. Cl.
CPC ..... *B21K 17/00* (2013.01); *A63B 53/02* (2013.01); *A63B 53/047* (2013.01); *C21D 6/004* (2013.01);
(Continued)

(58) Field of Classification Search
None
See application file for complete search history.

(56) References Cited

U.S. PATENT DOCUMENTS 5,599,408 A * 2/1997 Fujita ..... C21D 1/78 148/607
2007/0084528 A1* 4/2007 Liu ..... C21D 6/002 148/619
(Continued)

FOREIGN PATENT DOCUMENTS

CN 1800448 A 7/2006
CN 1831179 A 9/2006
CN 104451423 A * 3/2015

OTHER PUBLICATIONS

Translation of JP 60-29418 (published Feb. 1985) form J-Plat Pat.*
(Continued)

*Primary Examiner* — George Wyszomierski
(74) *Attorney, Agent, or Firm* — Alan D. Kamrath; Karin L. Williams; Mayer & Williams PC

(57) ABSTRACT

A method for manufacturing a golf club head includes providing a club head body produced by electric smelting an alloy base material including 0.04-0.07 wt % of carbon, 0.5-1.0 wt % of manganese, 0.5-1.0 wt % of silicon, less than 0.04 wt % of phosphorus, less than 0.03 wt % of sulfur, 15-17.7 wt % of chromium, 3.6-5.1 wt % of nickel, 2.8-3.5 wt % of copper, with the rest being iron and inevitable impurities. A solid solution treatment is proceeded at 1020-1080° C. for 80-100 minutes to form austenite and martensite in the club head body. A deep cooling treatment is proceeded between −120° C. and −80° C. for 7-9 hours to turn the austenite in the club head body into martensite. An aging treatment is proceeded on the club head body at 460-500° C. for 210-270 minutes to provide a hardness of HRC 36-46. A hosel is heated with high frequency waves at 900-1000° C. to posses a hardness lower than HRC 20.

8 Claims, 2 Drawing Sheets

(51) Int. Cl.

| | |
|---|---|
| ***C22C 38/42*** | (2006.01) |
| ***C22C 38/04*** | (2006.01) |
| ***C21D 6/00*** | (2006.01) |
| ***A63B 53/02*** | (2015.01) |
| ***A63B 53/04*** | (2015.01) |

(52) U.S. Cl.
CPC ..... *C21D 6/04* (2013.01); *C22C 38/04* (2013.01); *C22C 38/42* (2013.01); *C21D 2211/001* (2013.01); *C21D 2211/008* (2013.01)

(56) References Cited

U.S. PATENT DOCUMENTS

2010/0018615 A1* 1/2010 Cao ..... C21D 1/60
148/608
2011/0232809 A1* 9/2011 Chen ..... C21D 8/005
148/578

OTHER PUBLICATIONS

Translation of CN 104451423 (published Mar. 2015) from Espacenet.*

* cited by examiner

METHOD FOR MANUFACTURING A GOLF CLUB HEAD

CROSS REFERENCE TO RELATED APPLICATIONS

The application claims the benefit of China application serial No. 201610910272.4 filed on Oct. 19, 2016, and the entire contents of which are incorporated herein by reference.

BACKGROUND

1. Technical Field

The present invention relates to a method for manufacturing a golf club head and, more particularly, to a method for manufacturing a custom-made golf club head.

2. Description of the Related Art

Golf club heads generally have certain requirements in the surface strength to avoid easy deformation after striking many times to thereby avoid adverse influence on the striking performance. However, an adjustment of an inclination angle of a high-strength golf club head is not easy. Thus, a need exists for a novel method for manufacturing a golf club head to solve the above disadvantages.

SUMMARY

The present invention provides a method for manufacturing a golf club head fulfilling the strength requirements while permitting easy adjustment of the inclination angle.

A method for manufacturing a golf club head according to the present invention includes providing a club head body including a hosel. The club head body is produced by electric smelting an alloy base material including 0.04-0.07 wt % of carbon, 0.5-1.0 wt % of manganese, 0.5-1.0 wt % of silicon, less than 0.04 wt % of phosphorus, less than 0.03 wt % of sulfur, 15-17.7 wt % of chromium, 3.6-5.1 wt % of nickel, 2.8-3.5 wt % of copper, with the rest being iron and inevitable impurities. A solid solution treatment is proceeded on the club head body at 1020-1080° C. for 80-100 minutes to form austenite and martensite in the club head body. A deep cooling treatment is proceeded on the club head body at a temperature in a range between −120° C. and −80° C. for 7-9 hours to turn the austenite in the club head body into martensite. An aging treatment is proceeded on the club head body at 460-500° C. for 210-270 minutes to provide the club head body with a hardness of HRC 36-46. The hosel of the club head body is heated with high frequency waves at 900-1000° C. to provide the hosel with a hardness lower than HRC 20.

In the method for manufacturing a golf club head according to the present invention, the metallographic structure of the club head body can be altered by a solid solution treatment, a deep cooling treatment, an aging treatment, and a high frequency wave heating treatment on the club head body to increase the hardness and the abrasion strength of the club head body, obtaining a club head body having a hardness of HRC 36-46 and including a hosel with a hardness lower than HRC 20. Furthermore, the club head body is produced from an alloy base material including 0.04-0.07 wt % of carbon, 0.5-1.0 wt % of manganese, 0.5-1.0 wt % of silicon, less than 0.04 wt % of phosphorus, less than 0.03 wt % of sulfur, 15-17.7 wt % of chromium, 3.6-5.1 wt % of nickel, 2.8-3.5 wt % of copper, with the rest being iron and inevitable impurities. Thus, the club head body includes high strength while permitting easy adjustment of the inclination angle.

In an example, the alloy base material includes 16.4-16.7 wt % of chromium and 4.7-5.1 wt % of nickel. This provides the club head body with better hardness and better angle adjustability.

In an example, the hosel includes a hole having an opening and a bottom spaced from the opening by 30-33 mm. The high frequency wave heating on the hosel is conducted within an area having a spacing not larger than 7.5 mm to the bottom of the hole. Thus, the inclination angle of the club head body can be effectively adjusted.

In an example, a nickel layer of 18-25 μm is electroplated on a surface of the club head body after the aging treatment, and the hosel of the club head body is then heated to adjust the angle of the hosel. The club head body is prevented from rusting through provision of the nickel layer.

In an example, a chromium layer of 3-8 μm is electroplated on a surface of the nickel layer, and the hosel of the club head body is then heated to adjust the angle of the hosel. The abrasion strength and the hardness of the club head body can be increased by the chromium layer.

In an example, the method for manufacturing a golf club head further includes adjusting an angle of the hosel after heating the hosel of the club head body with high frequency waves. Adjusting the angle of the hosel includes applying a torque less than 80 pounds to achieve an angle adjustment of ±2°.

The present invention will become clearer in light of the following detailed description of illustrative embodiments of this invention described in connection with the drawings.

DETAILED DESCRIPTION

A method for manufacturing a golf club head according to the present invention includes preparing a club head body 1 that is subject to the steps including a solid solution treatment, a deep cooling treatment, an aging treatment, and a high frequency wave heating treatment to obtain a golf club head fulfilling the user needs.

Specifically, a club head body 1 having a hosel 11 (see FIG. 1) is provided. The club head body 1 is produced by electric smelting an alloy base material including 0.04-0.07 wt % of carbon, 0.5-1.0 wt % of manganese, 0.5-1.0 wt % of silicon, less than 0.04 wt % of phosphorus, less than 0.03 wt % of sulfur, 15-17.7 wt % of chromium, 3.6-5.1 wt % of nickel, 2.8-3.5 wt % of copper, with the rest being iron and inevitable impurities. Preferably, the alloy base material includes 16.4-16.7 wt % of chromium and 4.7-5.1 wt % of nickel. Through adjustment of the contents of chromium and nickel, the hardness, the strength, and the torque of the resultant club head body 1 can fulfill the needs while providing the club head body 1 with enhanced angle adjustability.

The solid solution treatment is conducted on the club head body 1 at 1020-1080° C. for 80-100 minutes, such that a portion of the metallographic structure of the club head body 1 can dissolve in the solid solution. Thus, the metallographic structure in the club head body 1 includes austenite and martensite.

After the solid solution treatment, the deep cooling treatment is conducted on the club head body 1 at a temperature in a range between −120° C. and −80° C. for 7-9 hours to turn the austenite in the club head body 1 into martensite. Thus, the hardness and the abrasion strength of the club head body 1 can be increased.

After the deep cooling treatment, the aging treatment is conducted on the club head body 1 at 460-500° C. for 210-270 minutes, thereby precipitating and strengthening the club head body 1. Thus, the hardness of the club head body 1 is in a range of HRC 36-46.

In the high frequency wave heating treatment, the hosel 11 of the club head body 1 is performed after the aging treatment. The martensite in the hosel 11 turns back into austenite to provide the hosel 11 with a hardness lower than HRC 20. In this embodiment, the hosel 11 of the club head body 1 is heated with high frequency waves at 900-1000° C. for about 20-30 seconds.

Figure 1:
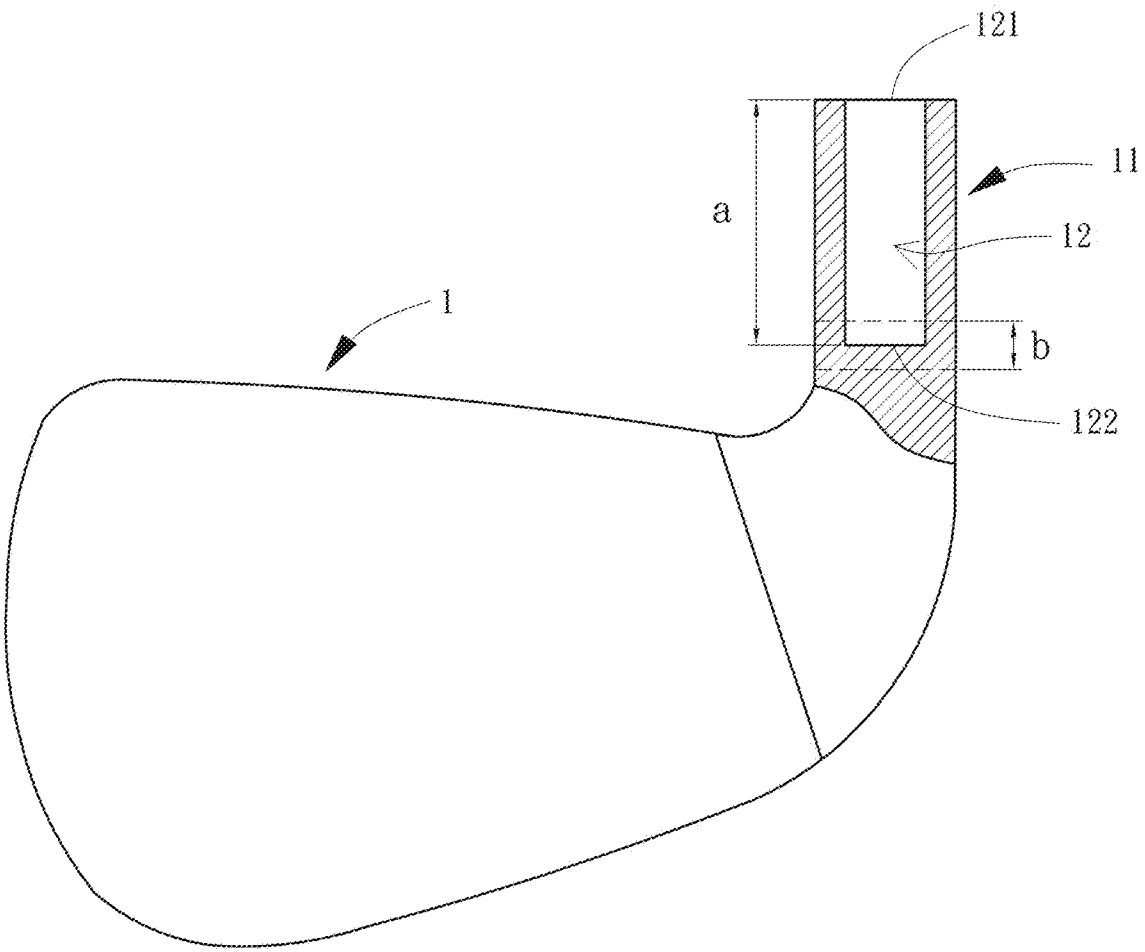
FIG. 1 is a diagrammatic view illustrating an area of a hosel of a club head body to be heated by high frequency waves for subsequent angle adjustment of the hosel by a method according to the present invention.

With reference to FIG. 1, it is noted that the hosel 11 includes a hole 12 having an opening 121 and a bottom 122 spaced from the opening 121 by a spacing a of 30-33 mm. The high frequency wave heating on the hosel 11 is conducted within an area b having a spacing not larger than 7.5 mm to the bottom 122 of the hole 12.

The club head body 1 obtained after the solid solution treatment, the deep cooling treatment, the aging treatment, and the high frequency wave heating treatment, not only has high strength but permits easy adjustment of an inclination angle of the hosel 11. Thus, the method for manufacturing a golf club head according to the present invention can further include a step of adjusting an angle of the hosel 11 after heating the hosel 11 of the club head body 1 with high frequency waves. In this case, a torque less than 80 pounds can be applied to achieve an angle adjustment of ±2°.

To prevent the club head body 1 from rusting, a surface electroplating step can be carried out after the aging treatment. A nickel layer of 18-25 μm is electroplated on a surface of the club head body 1 after the aging treatment. Since the nickel layer has a low hardness, a chromium layer of 3-8 μm is preferably electroplated on a surface of the nickel layer to increase the abrasion strength and the hardness of the club head body 1 by the chromium layer.

To prove the method according to the present invention can be used to manufacture a golf club head (which permits easy adjustment of the inclination angle) through the solid solution treatment, the deep cooling treatment, the aging treatment, and the high frequency wave heating treatment, experiments were carried out on club head bodies made of alloy base materials including 0.04-0.07 wt % of carbon, 0.5-1.0 wt % of manganese, 0.5-1.0 wt % of silicon, less than 0.04 wt % of phosphorus, less than 0.03 wt % of sulfur, 16.4-16.7 wt % of chromium, 4.7-5.1 wt % of nickel, 2.8-3.5 wt % of copper, with the rest being iron and inevitable impurities.

Figure 2A:
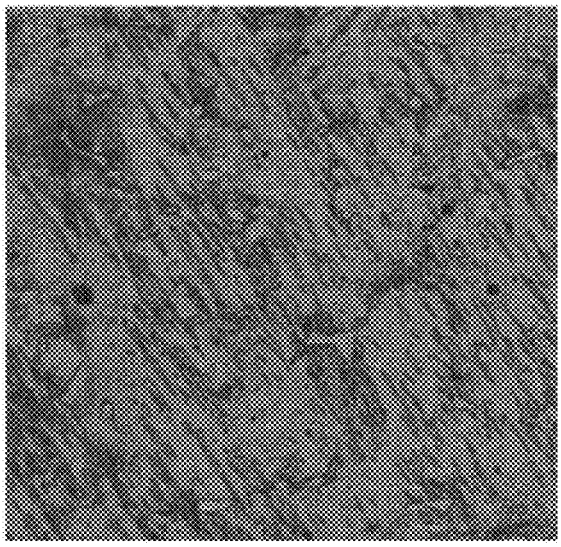
FIG. 2*a* is a result of a metallographic analysis on a metallographic structure of group A1 in test A.
Figure 2B:
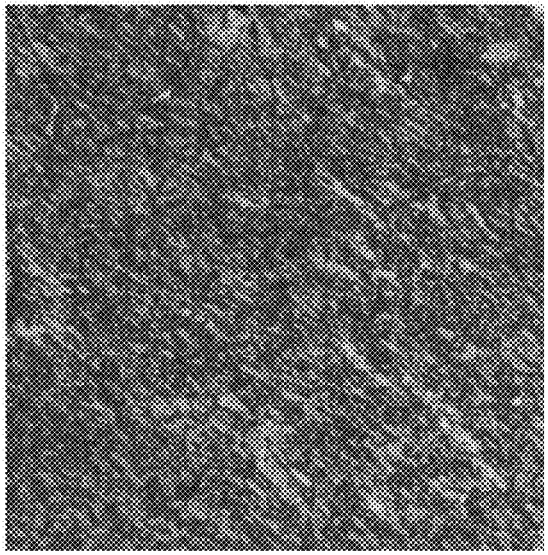
FIG. 2*b* is a result of a metallographic analysis on a metallographic structure of group A2 in test A.

(A) Change in the Metallographic Structure Before and after Deep Cooling Treatment With reference to Table 1, in this experiment, analysis of the metallographic structures of club head bodies after the solid solution treatment and before the deep cooling treatment (group A1) and club head bodies after the solid solution treatment and then the deep cooling treatment (group A2) are carried out, and the results are shown in FIG. 2*a* and FIG. 2*b*, respectively. In Table 1, "O" represents the treatment is carried out, and "X" represents the treatment is not carried out.

TABLE 1

Processing Conditions of Each Group of Experiment

| Group | Solid solution treatment | Deep cooling treatment | FIG. |
|---|---|---|---|
| A1 | ○ | X | 2a |
| A2 | ○ | ○ | 2b |

(B) Influence of Temperature of Deep Cooling Treatment and Aging Treatment Time

With reference to FIGS. 2 and 2*b*, in this experiment, the processing temperatures were −80° C. and −120° C., and the processing times of the aging treatment were 1 hour and 4 hours. The hardness, the torque, the tensile strength, the yield strength, and the elongation of each group were measured.

TABLE 2

Processing Conditions of Each Group of Experiment

| Group | Deep cooling temperature (° C.) | Aging treatment time (hr) | Hardness (HRC) | Torque (lb) | Tensile strength (Ksi) | Yield strength (Ksi) | Elongation (%) |
|---|---|---|---|---|---|---|---|
| B1 | −80 | 1 | 43.0 | 69.5 | 195.0 | 175.0 | 10.0 |
| B2 | −120 | 1 | 43.2 | 68.4 | 197.0 | 175.0 | 9.94 |
| B3 | −80 | 4 | 42.4 | 65.2 | 186.0 | 173.0 | 10.1 |
| B4 | −120 | 4 | 42.5 | 66.1 | 190.0 | 176.0 | 10.4 |

According to the above experiment result, the performances of the club head bodies are not much affected by the processing temperatures of the deep cooling treatments. However, when the aging treatment time is longer, the hardness and the yield strength are slightly reduced, the elongation is slightly increased, and the torque is slightly decreased. This shows that the angle adjustability of the club head bodies is improved.

(C) Influence of Aging Treatment

In this experiment, the solid solution treatment, the deep cooling treatment, the aging treatment, and the high frequency wave heating treatment were carried out in sequence on group C1. Furthermore, the solid solution treatment, the deep cooling treatment, the high frequency wave heating treatment, and the aging treatment were carried out on group C2. The torques for adjusting the angles of the club head bodies of each of group C1 and group C2 were measured. The average torque of group C1 is 67.3 lb. The average torque of group C2 is 82.8 lb. Apparently, the angle adjustability of the club head bodies of group C1 is better.

(D) Influence of Contents of Chromium, Nickel, and their Sum on the Angle Adjustability With reference to Table 3, in this experiment, the contents of chromium and nickel and the sum of the contents of chromium and nickel in the alloy base materials were adjusted. Each alloy base material was subject to electric smelting to obtain a club head body which was, then, subject to the solid solution treatment, the deep cooling treatment, the aging treatment, and the high frequency wave heating treatment. Then, the hardness, the strength, and the torque of the club head bodies of each group were measured.

TABLE 3

Processing Conditions of Each Group of Experiment

| Group | Chromium (wt %) | Nickel (wt %) | Chromium + Nickel (wt %) | Hardness (HRC) | Strength (Ksi) | Torque (lb) |
|---|---|---|---|---|---|---|
| D1 | 15.36 | 4.21 | 19.57 | 42.0 | 199.0 | 92.4 |
| D2 | 15.87 | 4.16 | 20.03 | 42.4 | 199.3 | 93.8 |
| D3 | 15.64 | 4.89 | 20.53 | 42.0 | 191.0 | 80.5 |
| D4 | 15.91 | 4.67 | 20.58 | 42.5 | 189.0 | 68.9 |
| D5 | 15.94 | 4.65 | 20.59 | 40.6 | 186.6 | 58.0 |
| D6 | 16.38 | 4.99 | 21.37 | 41.6 | 180.0 | 32.1 |

According to the above experiment result, the hardness, the strength, and the torque of the club head bodies decrease when the contents of chromium and nickel increase. Furthermore, when the chromium content is less than 15.9% and the nickel content is less than 4.4%, the angle adjustability of the club head bodies is compromised. Additionally, considering the composition difference before and after the electric smelting of the alloy base materials, the alloy base materials preferably include 16.4-16.7 wt % of chromium and 4.7-5.1 wt % of nickel.

(E) Cannon Shot Test

With reference to Table 4, in this experiment, the contents of chromium and nickel in the alloy base materials were adjusted. Each alloy base material was subject to electric smelting to obtain a club head body which was, then, subject to the solid solution treatment, the deep cooling treatment, the aging treatment, and the high frequency wave heating treatment. Finally, a cannon shot test was carried on the striking face of each club head body to record the number of shots and breakage of the striking face.

TABLE 4

Processing Conditions of Each Group of the Experiment

| Group | Chromium (wt %) | Nickel (wt %) | Thickness (mm) | Cannon shot conditions | Result | Judgment |
|---|---|---|---|---|---|---|
| E1 | 15.91 | 4.67 | 2.4 | 48 m/s, 3000 shots | No breakage | Pass |
| E2 | 16.38 | 4.99 | | | No breakage | Pass |

According to the above experiment result, the golf club head manufactured by the method according to the present invention can indeed fulfill the strength needs.

In view of the foregoing, in the method for manufacturing a golf club head according to the present invention, the metallographic structure of the club head body 1 can be altered by the solid solution treatment, the deep cooling treatment, the aging treatment, and the high frequency wave heating treatment on the club head body 1 to increase the hardness and the abrasion strength of the club head body 1, obtaining a club head body 1 having a hardness of HRC 36-46 and including a hosel 11 with a hardness lower than HRC 20. Furthermore, since the club head body 1 is produced from an alloy base material including 0.04-0.07 wt % of carbon, 0.5-1.0 wt % of manganese, 0.5-1.0 wt % of silicon, less than 0.04 wt % of phosphorus, less than 0.03 wt % of sulfur, 15-17.7 wt % of chromium, 3.6-5.1 wt % of nickel, 2.8-3.5 wt % of copper, with the rest being iron and inevitable impurities, the club head body 1 includes high strength while permitting easy adjustment of the inclination angle.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A method for manufacturing a golf club head, comprising:

providing a club head body including a hosel, wherein the club head body is produced by electric smelting an alloy base material including 0.04-0.07 wt % of carbon, 0.5-1.0 wt % of manganese, 0.5-1.0 wt % of silicon, less than 0.04 wt % of phosphorus, less than 0.03 wt % of sulfur, 15-17.7 wt % of chromium, 3.6-5.1 wt % of nickel, 2.8-3.5 wt % of copper, with the rest being iron and inevitable impurities;

proceeding with a solid solution treatment on the club head body at 1020-1080° C. for 80-100 minutes to form austenite and martensite in the club head body;

proceeding with a deep cooling treatment on the club head body at a temperature in a range between −120° C. and −80° C. for 7-9 hours to turn the austenite in the club head body into martensite;

proceeding with an aging treatment on the club head body at 460-500° C. for 210-270 minutes to provide the club head body with a hardness of HRC 36-46; and heating the hosel of the club head body at 900-1000° C. to provide the hosel with a hardness lower than HRC 20.

2. The method for manufacturing a golf club head as claimed in claim 1, wherein the alloy base material includes 16.4-16.7 wt % of chromium and 4.7-5.1 wt % of nickel.

3. The method for manufacturing a golf club head as claimed in claim 1, wherein the hosel includes a hole having an opening and a bottom spaced from the opening by 30-33 mm.

4. The method for manufacturing a golf club head as claimed in claim 3, wherein heating the hosel is conducted within an area having a spacing not larger than 7.5 mm to the bottom of the hole.

5. The method for manufacturing a golf club head as claimed in claim 1, wherein a nickel layer of 18-25 μm is electroplated on a surface of the club head body after the aging treatment, and wherein the hosel of the club head body is then heated to adjust an angle of the hosel.

6. The method for manufacturing a golf club head as claimed in claim 5, wherein a chromium layer of 3-8 μm is electroplated on a surface of the nickel layer, and wherein the hosel of the club head body is then heated to adjust an angle of the hosel.

7. The method for manufacturing a golf club head as claimed in claim 1, further comprising adjusting an angle of the hosel after heating the hosel of the club head body.

8. The method for manufacturing a golf club head as claimed in claim 1, wherein heating includes heating the hosel at 900-1000° C. for 20-30 seconds.

* * * * *